US010762832B2

(12) United States Patent
Zeng

(10) Patent No.: US 10,762,832 B2
(45) **Date of Patent: *Sep. 1, 2020**

(54) VISUAL PERSISTENCE DISPLAY DEVICE AND A VIDEO DISPLAY DEVICE

(71) Applicant: Shenzhen Tunkey Technology Co., Ltd., Shenzhen (CN)

(72) Inventor: RongYue Zeng, Shenzhen (CN)

(73) Assignee: Shenzhen Tunkey Technology Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/164,325

(22) Filed: Oct. 18, 2018

(65) Prior Publication Data

US 2019/0139484 A1 May 9, 2019

(30) Foreign Application Priority Data

Nov. 8, 2017 (CN) ..... 2017 1 1092692

(51) Int. Cl.

| | |
|---|---|
| ***G09G 5/10*** | (2006.01) |
| ***G09G 3/32*** | (2016.01) |
| ***G09G 3/00*** | (2006.01) |
| ***G09G 3/20*** | (2006.01) |

(52) U.S. Cl.

CPC ..... *G09G 3/32* (2013.01); *G09G 3/005* (2013.01); *G09G 3/2003* (2013.01); *G09G 2310/0224* (2013.01); *G09G 2310/08* (2013.01); *G09G 2320/046* (2013.01); *G09G 2320/0666* (2013.01); *G09G 2340/0407* (2013.01); *G09G 2340/0435* (2013.01)

(58) Field of Classification Search

CPC ... G09G 2310/0224; G09G 2320/0242; G09G 2320/0666; G09G 2340/0407; G09G 2340/0435; G09G 3/005; G09G 3/32

See application file for complete search history.

(56) References Cited

U.S. PATENT DOCUMENTS

2015/0357315 A1* 12/2015 Oraw ..... H01L 25/0753 315/294

2017/0061919 A1* 3/2017 Chen ..... G02F 1/0105

* cited by examiner

*Primary Examiner* — Insa Sadio

(74) *Attorney, Agent, or Firm* — Dinsmore & Shohl LLP; Thomas Anderson; Jeremy J. Justice

(57) ABSTRACT

The present application discloses a visual persistence display device and a video display device, wherein the visual persistence display device comprises: an electric motor, an RGB display unit, an RGB driving member and a control unit, wherein the control unit controls the operation of the motor unit, the RGB display unit rotates at a preset speed under the driving of the electric motor to form an image display surface, the control unit obtains the video code stream and decodes the video stream, and obtains the pixel data stream and sends it to the RGB driving unit; and the pixel data stream and the timing sequence control signal are sent to the RGB display unit for display so that the persistence of vision display can display more abundant.

10 Claims, 3 Drawing Sheets

VISUAL PERSISTENCE DISPLAY DEVICE AND A VIDEO DISPLAY DEVICE

CROSS REFERENCE TO RELATED APPLICATIONS

This application claims priority to Chinese Patent Application No. 201711092692.7, filed on Nov. 8, 2017, entitled "a visual persistence display device and a video display device", which is hereby incorporated by reference into this application as if fully set forth herein.

FIELD OF THE INVENTION

The present application relates to technical field of electronics, and especially to a visual persistence display device and a video display device.

BACKGROUND OF THE INVENTION

With the development of multimedia communication technology, display screens for advertising can be seen everywhere in the city, for example, LED (Light Emitting Diode) display, liquid crystal display and visual persistence display (POV-LED, Visual persistence Light Emitting) Diode) and so on.

Although the existing visual persistence display can realize the display of the pattern or the text content by setting the LED lamp at the corresponding position of the LED lamp strip, but only after the position of the LED lamp is determined, only the image or text content corresponding to the lamp position of the LED light can be displayed. Therefore, in the prior art, the visual persistence display screen has a problem that the display content is too singular.

SUMMARY OF THE INVENTION

The present application provides a visual persistence display device and a video display device according to an embodiment, which can make the content that can be displayed on the visual persistence display screen more abundant.

In a first aspect, an embodiment of the present application provides a visual persistence display device, where the visual persistence display device includes:

An electric motor;

an RGB display unit, which is connected to the electric motor and configured for rotating at a preset speed under the driving of the electric motor to form an image display surface;

an RGB driving member, which is connected to the RGB display unit and configured for generating a timing sequence control signal when the pixel data stream is received, and send the pixel data stream and the timing sequence control signal to the RGB display unit for display; and a control unit, which is connected to the electric motor and to the RGB driving member respectively and configured for controlling the operation of the electric motor, acquiring a video code stream, and decoding the video code stream to obtain the pixel data stream.

In a second aspect, an embodiment of the present application further provides a rechargeable battery including a battery core, which further includes the visual persistence display device in the first aspect.

The embodiment of the present application provides a visual persistence display device and a video display device, the control unit controls the operation of the electric motor, and the RGB display unit rotates at a preset rotation speed to form an image display surface, and the control unit obtains the pixel data stream and send to the RGB driving member by acquiring a video code stream and decoding the video code stream; when the pixel data stream is received by using RGB driving member, the timing sequence control signal is generated, and the when the pixel data stream is received by the RGB driving member, the timing sequence control signal is generated, and the pixel data stream and the timing sequence control signal are sent to the RGB display unit for display so that the visual persistence display can display more abundant.

BRIEF DESCRIPTION OF THE DRAWINGS

In order to make the technical solutions in the embodiments of the present application clearer, the accompanying drawings to be used in the embodiments and the description of the prior art will be briefly introduced below, it is apparent that the drawings in the following description are merely some embodiments of the present application and that other drawings may be obtained by those skilled in the field without departing from the inventive nature of the application.

DETAILED DESCRIPTION OF THE PREFERRED EMBODIMENTS

The technical solutions in the embodiments of the present application are clearly and completely described in the following with reference to the accompanying drawings in the embodiments of the present application. It is obvious that the described embodiments are a part of the embodiments of the present application, but not all of the embodiments. All other embodiments obtained by those skilled in the art based on the embodiments of the present application without creative efforts are within the scope of the present application.

Figure 1:
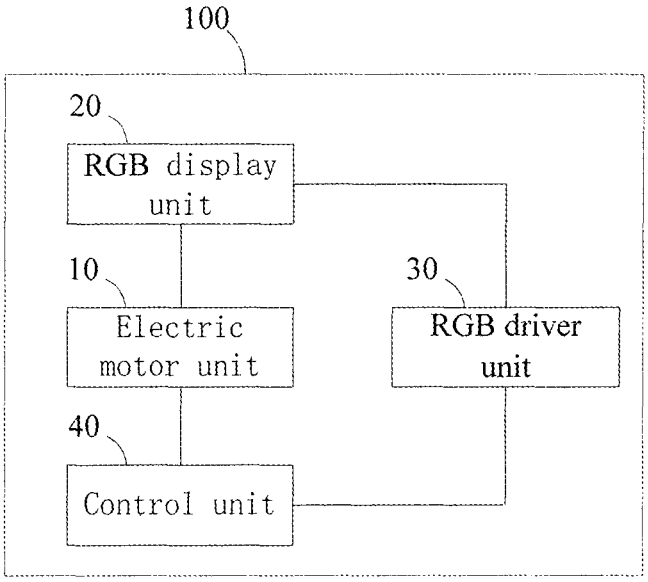
FIG. 1 is a schematic structural view of a visual persistence display device according to an embodiment of the present application.

Please refer to FIG. 1, FIG. 1 is a schematic structural view of a visual persistence display device according to an embodiment of the present application. As shown in FIG. 1, a visual persistence display device 100 includes an electric motor 10, an RGB display unit 20, an RGB driving member 30, and a control unit 40, specifically:

The electric motor 10, which is configured to drive the RGB display unit 20 to rotate.

The RGB display unit 20 is connected to the electric motor 10 and configured for rotating at a preset rotational speed under the driving of the electric motor 10 to form an image display surface.

The RGB driving member 30, which is connected to the RGB display unit 20 and configured for generating a timing sequence control signal upon receiving the pixel data stream, and transmitting the pixel data stream and the timing sequence control signal to the RGB display unit 20 for display.

The control unit 40, which is connected to the electric motor 10 and to the RGB driving member 30 respectively and configured for controlling the operation of the electric motor 10, acquiring a video code stream, and decoding the video code stream to obtain a pixel data stream.

In this embodiment, the control unit 40 is configured to control the rotation speed of the electric motor 10, and the RGB display unit 20 rotates at a preset rotation speed under the driving of the electric motor 10 to form an image display surface, wherein the value of the rotation speed of the electric motor 10 is corresponded to the refresh rate of the image display surface, that is, the value of the rotation speed of the electric motor 10 equal to the refresh rate of the image display surface.

For example, the refresh rate of the image display surface is 24 frames per second, and the rotational speed of the electric motor 10 is 24 revolutions per second (r/S).

It should be noted that when the RGB driving member 30 receives the pixel data stream, a timing sequence control signal corresponding to the pixel data stream is generated, and the RGB display unit 20 displays the color corresponding to the pixel data stream according to the timing sequence control signal.

In any of the embodiments of the present application, the control unit 40 controls the rotational speed of electric motor 10 by controlling the input current of electric motor 10. The control unit 40 obtains the video code stream by reading the video code stream in the storage unit or receiving the video code stream sent by other terminals, and decoding the video code stream to obtain a pixel data stream.

The RGB display unit 20 can be arranged by using RGB lamps or RGB lamps composed a matrix to rotate at a preset speed under the driving of the electric motor 10, and drive the RGB lamps or RGB lamps composed a matrix to move rapidly in the rotating surface to form an image display surface.

It should be noted that when the human eye views the object and images the object on the retina, the photoreceptor cells of the retina convert the light signal into a bioelectrical signal, which is transmitted to the brain through the visual nerve, and when the object is removed, The impression of the object to the visual nerve does not disappear immediately, which in turn creates a phenomenon of visual persistence. Therefore, when the RGB display unit 20 is driven by the electric motor 10, it rotates at a preset rotational speed, and drives the RGB lamps or RGB lamps composed a matrix to move rapidly in the rotating surface, so that the image in the rotating surface can be formed a persistence of image on the retina of the human, that is, an image display surface capable of displaying an image is formed.

In the above solution, the control unit controls the operation of the electric motor, and the RGB display unit rotates at a preset rotation speed to form an image display surface, and the control unit obtains the pixel data stream and send to the RGB driving member by acquiring a video code stream and decoding the video code stream; when the pixel data stream is received by using the RGB driving member, the timing sequence control signal is generated, and the when the pixel data stream is received by the RGB driving member, the timing sequence control signal is generated, and the pixel data stream and the timing sequence control signal are sent to the RGB display unit for display so that the visual persistence display can display more abundant.

Figure 2:
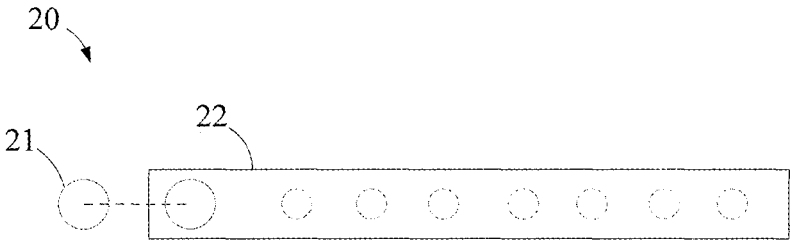
FIG. 2 is a schematic view of a specific structure of an RGB display unit in a visual persistence display device according to an embodiment of the present application.

Please refer to FIG. 2, FIG. 2 is a schematic view of a specific structure of an RGB display unit in a visual persistence display device according to an embodiment of the present application. As shown in FIG. 2, based on the foregoing embodiment, as a possible implementation manner of the embodiment, the RGB display unit 20 includes:

A electric motor coupler 21, which is configured for coupling with a driving shaft of the electric motor 10.

An RGB lamp strip assembly 22 fixedly, which is connected to the electric motor coupler 21 and configured for arranging RGB lamps.

When the control unit 40 controls the operation of the electric motor 10, the electric motor 10 drives the RGB lamp strip assembly 22 to rotate at a preset rotational speed through the driving shaft of the electric motor, so that the RGB lamps moves uniformly at the rotating surface of the RGB lamp strip assembly to form an image display surface.

In this embodiment, the RGB driving member 30 is specifically configured to receive the pixel data stream sent by the control unit 40, generate a timing sequence control signal according to the pixel data stream, and send the pixel data stream together with the timing sequence control signal to the RGB lamp for display.

It should be noted that, in order to make the pattern in the image display surface continuous and undistorted when the RGB display unit 20 is rotated, all the RGB lamps on the RGB lamp strip correspond to the same timing sequence control signal, and the pixel data streams respectively act on each of the RGB lamps to control the display color of each RGB lamp so that the image displayed on the image display surface observed by the human eye is continuous and undistorted.

It can be understood that the electric motor coupler 21 is fixed with the driving shaft of the electric motor 10 by providing a thread or a clipping mechanism at inner side thereof, and the electric motor coupler 21 is fixed with the RGB lamp strip assembly 22 by providing a thread at outer side thereof. In all the embodiments of the present application, the electric motor coupler 21 can use the existing connection structure for coupling with the electric motor driving shaft, which is not shown in the drawings, and will not be described herein.

Figure 3A:
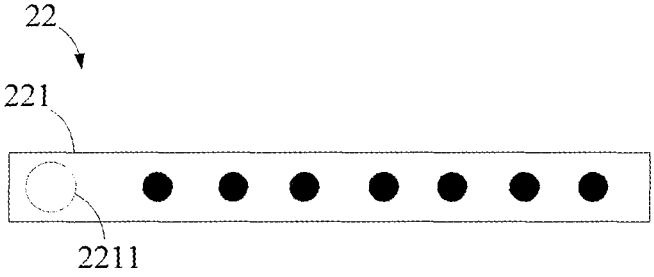
FIGS. 3A to 3D are schematic views showing a specific structure of an RGB lamp strip assembly in a visual persistence display device according to embodiments of the present application.

FIGS. 3A to 3E are schematic views showing a specific structure of an RGB lamp strip assembly in a visual persistence display device according to an embodiment of the present application. As shown in FIG. 3A, as a possible implementation manner of this embodiment, the RGB lamp strip assembly 22 includes a first RGB lamp strip 221.

As shown in FIG. 3A, the first RGB lamp strip 221 is a rectangular strip, and the first RGB lamp strip 221 is provided with a first connection portion 2211 for fixedly connecting with the electric motor coupler 21, and the first connection portion is located at an end of the rectangular strip shape in its length direction.

Figure 3B:
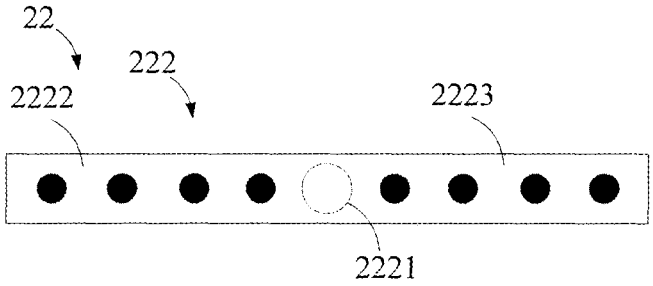

As shown in FIG. 3B, as a possible implementation manner of this embodiment, the RGB lamp strip assembly includes: a second RGB lamp strip 222.

The second RGB lamp strip 222 is a rectangular strip, and the second RGB lamp strip 222 is provided with a second connection portion 2221 for fixedly connecting with the electric motor coupler, and the second connection portion 2221 is located at an axially central position of the rectangular strip. In the present embodiment, the central axis of the rectangular strip and the central axis of the driving shaft of the electric motor coincide with each other.

As shown in FIG. 3B, as a possible implementation manner of the embodiment, the second RGB lamp strip 222 is provided with a plurality of RGB lamps uniformly spaced along the length thereof.

Specifically, the center position of the rectangular strip is a symmetrical point, and a first lamp strip body 2222 and the second lamp strip body 2223 are respectively extended toward along both ends in the longitudinal direction of the rectangular strip.

A plurality of RGB lamps are respectively disposed on the first lamp strip body 2222 and the second lamp strip body 2223, wherein the center line in the longitudinal direction of the rectangular strip body is a symmetrical axis, and a plurality of the RGB lamps on the first lamp strip body 2222 are symmetrical with a plurality of RGB lamps on the second lamp strip body 2223.

Figure 3C:
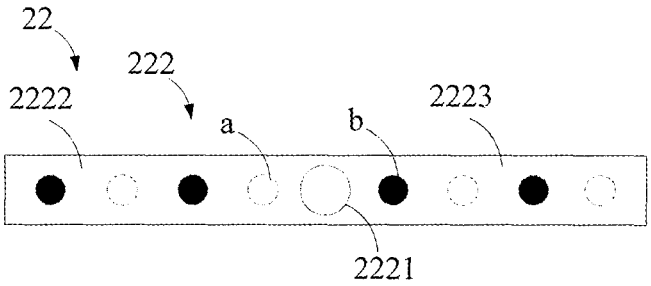

As shown in FIG. 3C, as another possible implementation manner of the embodiment, the second RGB lamp strip 222 has a plurality of dummy areas a distributed evenly along the length thereof, and a plurality of RGB lamps b and a plurality of dummy areas a are alternately distributed.

Specifically, the center position of the rectangular strip is a symmetrical point, and a first lamp strip body 2222 and the second lamp strip body 2223 are respectively extended toward along both ends in the longitudinal direction of the rectangular strip.

A plurality of RGB lamps are respectively disposed on the first lamp strip body 2222 and the second lamp strip body 2223, wherein the plurality of RGB lamps on the first lamp strip body 2222 and the plurality of the RGB lamps on the second lamp strip body 2223 are alternately distributed.

For example, a plurality of lamp positions are symmetrically disposed on the first lamp strip body 2222 and the second lamp strip body 2223 respectively, and the lamp position is used to set RGB lamps, wherein the lamp position on the first lamp strip body 2222 has an odd number is empty, and the RGB lamp is provided at the lamp position on the first lamp strip body 2222 with an even number, and the RGB lamp is disposed at the lamp position on the second lamp strip body 2223 with an odd number, the lamp position on the second lamp strip body 22232 has an even number is empty.

It should be noted that, in order to reduce the density of the lamp strip body due to the excessive setting of the RGB lamp, and causing the temperature of the lamp strip body is too high, therefore, in the case that the picture presented by the rotation of the lamp strip body is undistorted, the plurality of RGB lamps disposed on the first lamp strip body 2222 and the RGB lamps disposed on the second lamp strip body 2223 are alternately distributed to ensure the resolution of the image display surface and improve the reliability of the RGB lamp strip.

In the present embodiment, in order to increase the refresh rate of the RGB display unit 20, it can be realized by increasing the rotational speed of the electric motor 10, and also by arranging more RGB lamp strips.

Figure 3D:
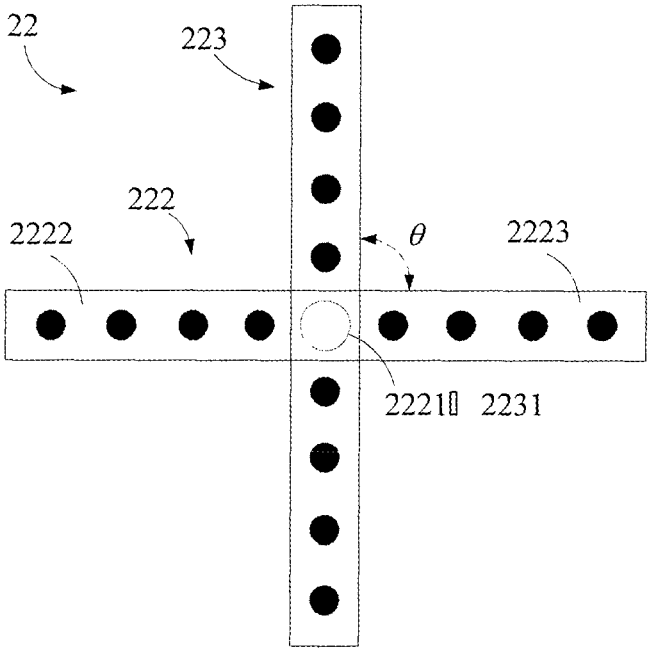

As shown in FIG. 3D, as another possible implementation manner of the embodiment, the RGB lamp strip assembly 22 further includes: a third RGB lamp strip 223 having the same structure as the second RGB lamp strip 222.

A third connection portion 2231 of the third RGB lamp strip 223 at its axially central position for fixedly connecting with the electric motor coupler 21.

As shown in FIG. 3D, the angle between the second RGB lamp strip 222 and the third RGB lamp strip 223 in the direction of rotation is less than or equal to 90 degrees.

The electric motor 10 only drives the second RGB lamp strip 222 to rotate, and the second RGB lamp strip 222 and the third RGB lamp strip 223 are rotated together with the electric motor 10 as an example. If the image display surface can display an image normally when the electric motor 10 only drives the second RGB lamp strip 222 at a rotation speed of 24 rpm, when the electric motor 10 simultaneously drives the second RGB lamp strip 222 and the third RGB lamp strip to rotate, it only needs to work at the rotation speed of 12 rpm, and the effect of rotating the second RGB lamp strip 222 at a rotation speed of 24 rpm can be realized.

In the present embodiment, since the third RGB lamp strip 223 is added to the second RGB lamp strip 222, the effect of increasing the refresh rate can be achieved without increasing the rotational speed of the electric motor 10.

The operation principle of the visual persistence display device 100 in the present embodiment will be described in detail below with reference to FIGS. 1 to 3D.

As shown in FIG. 1 and FIG. 2, the control unit 40 controls the operation of the electric motor 10, the electric motor 10 drives the RGB lamp strip assembly 22 to rotate at a preset rotational speed by the electric motor coupler 21, so that the RGB lamps is moved at a constant speed in the rotation surface of the RGB lamp strip assembly to form an image display surface. At the same time, the control unit 40 obtains the video code stream and decodes the video code stream to obtain a pixel data stream and sends it to the RGB driving member 30, when the RGB driving member 30 receives the pixel data stream, and generates a timing sequence control signal, and the pixel data stream and the timing sequence control signal are sent to the RGB display unit 20 for display.

When the RGB lamp strip assembly 22 rotates at a preset rotation speed, the RGB lamps on the first RGB lamp strip 221, the second RGB lamp strip 222, and/or the third RGB lamp strip 223 are displayed corresponding colors according to the pixel data stream and the timing sequence control signal, therefore playing the video corresponding to the video code stream in the image display surface is realized In the above solution, the control unit controls the operation of the electric motor, and the RGB display unit rotates at a preset rotation speed to form an image display surface, and the control unit obtains the pixel data stream and send to the RGB driving member by acquiring a video code stream and decoding the video code stream; when the pixel data stream is received by using the RGB driving member, the timing sequence control signal is generated, and the when the pixel data stream is received by the RGB driving member, the timing sequence control signal is generated, and the pixel data stream and the timing sequence control signal are sent to the RGB display unit for display so that the visual persistence display can display more abundant.

The plurality of RGB lamps disposed on the first lamp strip body 2222 and the RGB lamps disposed on the second lamp strip body 2223 are alternately distributed, thereby ensuring the resolution of the image display surface and improving the reliability of the RGB lamp strip. The third RGB lamp strip 223 is added to the second RGB lamp strip 222, the effect of increasing the refresh rate can be achieved without increasing the rotational speed of the electric motor 10.

Figure 4:
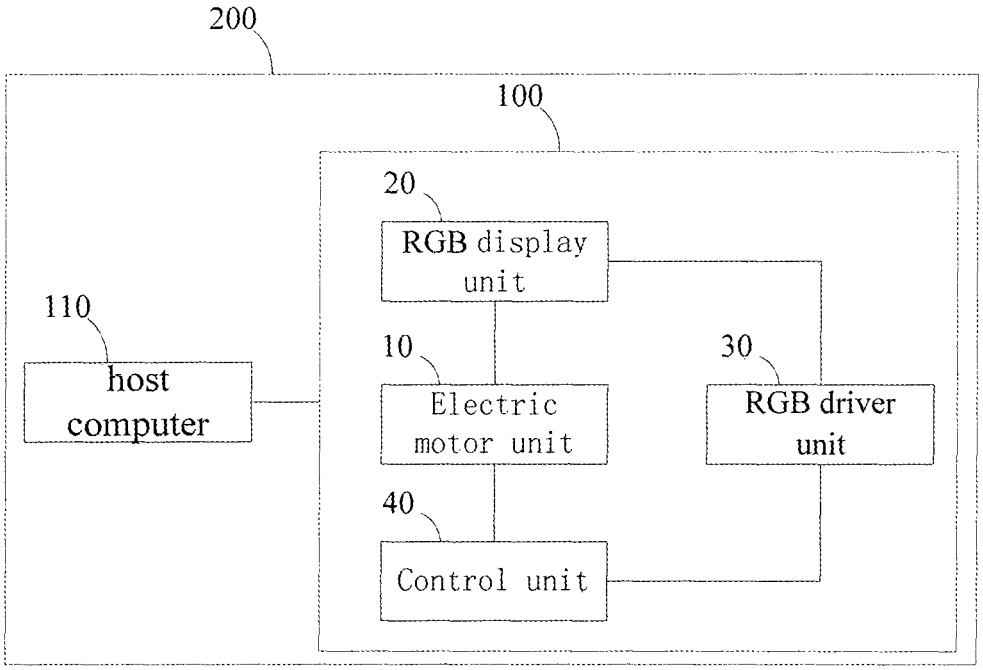
FIG. 4 is a schematic structural view of a video display device according to an embodiment of the present application.

FIG. 4 is a schematic structural view of a video display device according to an embodiment of the present application. As shown in FIG. 4, the video display device 200 includes a host computer 110, and further includes a visual persistence display device 100 in the above embodiment.

It is to be understood that the content and the implementation manner related to the video display device 200 of the present embodiment are described in detail in the foregoing, and therefore are not described herein again.

In the above solution, the control unit controls the operation of the electric motor, and the RGB display unit rotates at a preset rotation speed to form an image display surface, and the control unit obtains the pixel data stream and send to the RGB driving member by acquiring a video code stream and decoding the video code stream; when the pixel data stream is received by using the RGB driving member, the timing sequence control signal is generated, and the when the pixel data stream is received by the RGB driving member, the timing sequence control signal is generated, and the pixel data stream and the timing sequence control signal are sent to the RGB display unit for display so that the visual persistence display can display more abundant.

The units of the terminal in the embodiment of the present application may be combined, divided, and deleted according to actual needs. It's obvious that the aforementioned embodiments are only preferred embodiments of the present application, and are not intended to limit the present application. Any modification, equivalent replacement, improvement, and so on, which are made within the spirit and the principle of the present application, should be comprised in the scope of the present application.

What is claimed is:

1. A visual persistence display device, wherein the visual persistence display device comprises:

an electric motor;

an RGB display unit, which is connected to the electric motor and configured for rotating at a preset speed under the driving of the electric motor to form an image display surface;

an RGB driving member, which is connected to the RGB display unit and configured for generating a timing sequence control signal when the pixel data stream is received, and send the pixel data stream and the timing sequence control signal to the RGB display unit for display; and a control unit, which is connected to the electric motor and to the RGB driving member respectively and configured for controlling the operation of the electric motor, acquiring a video code stream, and decoding the video code stream to obtain the pixel data stream.

2. The visual persistence display device of claim 1, wherein the RGB display unit comprises: an electric motor coupler for coupling with a driving shaft of the electric motor; an RGB lamp strip assembly, which is fixedly connected to the electric motor coupler and is configured for setting RGB lamps; wherein, when the control unit controls the operation of the electric motor, the electric motor drives the RGB lamp strip assembly to rotate at the preset rotation speed via the driving shaft of the electric motor, so that the RGB lamp is rotated at a constant speed in a rotation surface of the RUB lamp strip to form an image display surface.

3. The visual persistence display device of claim 2, wherein the RGB driving member is configured to receive the pixel data stream sent by the control unit, and generate timing sequence control signal according to the pixel data stream, and transmitting the pixel data stream and the timing sequence control signal to the RGB lamp for display.

4. The visual persistence display device of claim 2, wherein the RGB lamp strip assembly comprises a first RGB lamp strip;

the first RGB lamp strip is a rectangular strip, and the first RGB lamp strip is provided with a first connection portion for fixedly connecting with the electric motor coupler, and the first connection portion is located at an end of the rectangular strip shape in its length direction.

5. The visual persistence display device according to claim 2, wherein the RGB lamp strip assembly comprises a second RGB lamp strip;

the second RGB lamp strip is a rectangular strip, and the second RGB lamp strip is provided with a second connection portion for fixedly connecting with the electric motor coupler, and the second connection portion is located at an axially central position of the rectangular strip.

6. The visual persistence display device of claim 5, wherein the second RGB lamp strip is provided with a plurality of RGB lamps distributed evenly along the length thereof.

7. The visual persistence display device of claim 5, wherein the second RGB lamp strip has a plurality of dummy areas evenly spaced along its length, and the plurality of RGB lamps and the plurality of dummy areas are alternately distributed.

8. The visual persistence display device according to any one of claims 5 to 7, wherein the RGB lamp strip assembly further comprises a third RGB lamp strip with the same structure as the second RGB lamp strip;

a third connection portion of the third RGB lamp strip at its axially central position is configured for fixed connection with the electric motor coupler.

9. The visual persistence display device of claim 8, wherein an angle between the second RGB lamp strip and the third RGB lamp strip in the direction of rotation is less than or equal to 90 degrees.

10. A video display device comprising a host computer, wherein the video display device further comprises the visual persistence display device according to any one of claim 1.

* * * * *